11/26/85 XR 4,555,446

United States Patent [19]

Sumida et al.

[11] Patent Number: 4,555,446

[45] Date of Patent: Nov. 26, 1985

[54] CARBON FIBER AND PROCESS FOR PREPARING SAME

[75] Inventors: Atsushi Sumida; Shizuo Watanabe, both of Ehime, Japan

[73] Assignee: Toray Industries, Incorporated, Japan

[21] Appl. No.: 508,576

[22] Filed: Jun. 28, 1983

[30] Foreign Application Priority Data

Jul. 5, 1982 [JP] Japan ..... 57-115334

[51] Int. Cl.[4] ..... D02G 3/00; B32B 9/00; B05D 3/12

[52] U.S. Cl. ..... 428/367; 428/408; 428/375; 428/392; 523/427; 523/403; 427/386; 427/389.9

[58] Field of Search ..... 428/367, 408, 392, 375, 428/378; 523/427, 403, 205; 427/386, 389.9, 394

[56] References Cited

U.S. PATENT DOCUMENTS

| | | | |
|---|---|---|---|
| 3,914,504 | 10/1975 | Weldy | 428/367 |
| 4,219,457 | 8/1980 | Taniguchi et al. | 428/367 |
| 4,315,044 | 2/1982 | Elmore et al. | 427/386 |
| 4,446,255 | 5/1984 | Ying et al. | 427/386 |
| 4,517,245 | 5/1985 | Spain | 427/386 |

*Primary Examiner*—George F. Lesmes
*Assistant Examiner*—Beverly K. Johnson
*Attorney, Agent, or Firm*—Scully, Scott, Murphy & Presser

[57] ABSTRACT

Carbon fiber superior in processability and in physical properties as a composite is obtained by treating carbon fiber with an epoxy resin composition incorporating a polyalkylene ether glycol derivative represented by the following general formula (I) or (II):

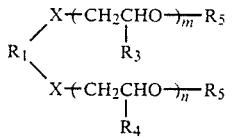

(I)

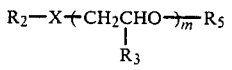

(II)

wherein $R_1$ is alkylene of $C_1$ to $C_{30}$, $R_2$ is alkyl of $C_1$ to $C_{30}$, $R_3$ and $R_4$ are each hydrogen or methyl, $R_5$ is glycidyl, X is ether linkage (—O—) or ester linkage

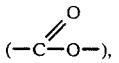

m and n are integers of 1 to 20.

4 Claims, No Drawings

CARBON FIBER AND PROCESS FOR PREPARING SAME

BACKGROUND OF THE INVENTION

The present invention relates to a carbon fiber superior in processability and in physical properties as a composite.

The carbon fiber is in wide use not only as aeronautic and cosmic structural materials such as those for aircrafts and rockets, but also as sporting members such as tennis rackets, golf shafts and fishing rods. In addition, it is about to be used as a structural material of transportation machinery such as automobiles and ships.

In a composite using carbon fiber as a reinforcing fiber, it is necessary that superior dynamic properties such as high specific strength and specific modulus of the carbon fiber be reflected as much as possible in the physical properties of the composite. At present, however, this requirement is not always met to a satisfactory extent.

On the other hand, it is said that the poor handling characteristic and processability ascribable to the intrinsic properties of being rigid and fragile of the carbon fiber makes it difficult to obtain composites having uniform quality and performance.

In general, various sizing agents are added to carbon fiber for improving the physical properties of a composite and for stabilizing the quality and performance thereof. But there scarcely is available a sizing agent superior in compatibility with and adhesion to the matrix which constitutes the composite, and capable of improving the physical properties of the composite and also improving the bundling and handling properties and rubbing resistance in forming of the carbon fiber such as preparing and weaving. Despite of many proposals, a satisfactory sizing agent has not been found out yet. For example, a sizing agent for carbon fiber (see Japanese Patent Publication No. 15229/1982) consisting mainly of an epoxy or polyester resin in an organic solvent, which sizing agent has been said to be uniform in adhesion to carbon fiber and superior in solution stability thereof and also superior in compatibility with and adhesion to matrix, including particularly various matrix resins, is not desirable from the standpoint of working efficiency, particularly from the standpoint of environmental hygiene as well as fire and other accidents prevention.

SUMMARY OF THE INVENTION it is an object of the present invention to provide a carbon fiber superior in compatibility with and adhesion to matrix, capable of being unwound in good condition from bobbin or the like in forming or weaving into prepreg or fabric, and capable of providing a composite which is superior in physical properties and which is difficult to give fluff or breakage of yarn even in contact or rubbing with a roller, a guide, etc.

It is another object of the present invention to provide a process for preparing such carbon fiber, and particularly to provide a resin composition for treating the surface of such carbon fiber.

It is a further object of the present invention to provide a process for preparing a sized carbon fiber which utilizes the superior sizing performance for carbon fiber, especially adhesion to matrix resin, of the above-mentioned surface-treatging resin composition (sizing agent), and which does not cause any trouble in environmental hygiene and in safety against accidents at the time of sizing treatment in an organic solvent.

Such objects of the present invention can be attained by a carbon fiber incorporating a resin composition as a sizing agent which comprises a polyalkylene ether glycol derivative of the following general formula (I) or (II) as an essential component blended with an epoxy resin:

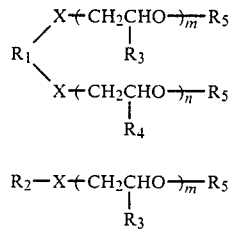

(I)

(II)

wherein $R_1$ is alkylene of $C_1$ to $C_{30}$, $R_2$ is alkyl or $C_1$ to $C_{30}$, $R_3$ and $R_4$ are each hydrogen or methyl, $R_5$ is glycidyl, X is ether linkage (—O—) or ester linkage

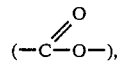

m and n are each an integer of 1 to 20.

As examples of the polyalkylene ether glycol derivative of the general formula (I) or (II) [hereinafter referred to as the derivative of the general formula (I) or (II)], mention may be made of, as $X—R_1—X$ of the derivative of the general formula (I), ethers such as 1,4-butanediol and 1,6-hexanediol, and esters of dibasic organic acids such as adipic, pimelic, suberic, azelaic and sebacic acids, while as $R_2—X$ of the derivative of the general formula (II), ethers such as pentyl alcohol, octyl alcohol, nonyl alcohol, lauryl alcohol, myristyl alcohol, pentadecyl alcohol and cetyl alcohol, as well as esters of fatty acids such as caprylic, lauric, palmitic, stearic, behenic and cerotic acids; further, as

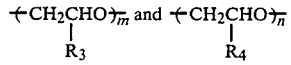

there may be mentioned addition products of ethylene oxide or propylene oxide; and $R_5$ is glycidyl group.

As the epoxy resin to be blended with the derivative of the general formula (I) or (II) there may be used known epoxy resins, for example, glycidyl ether type, glycidyl ester type, glycidyl amine type and aliphatic epoxide type epoxy resins, with glycidyl ether type being preferred.

The epoxy resin, as a 40 wt.% solution in diethylene glycol monobutyl ether, has a viscosity (at 25° C.) in the range of $A_1$ to $Z_5$, preferably D to Y as measured by a Gardner-Holdt viscometer. This viscosity is in terms of stoke determined by the viscosity determining method of Gardner-Holdt described at page 50 of Kuniyuki Hashimoto, "Epoxy Resin," the fourth edition (Jan. 30, 1973), Nikkan Kogyo Shinbun-Sha. If the viscosity of the eopoxy resin is lower than $A_1$, the resin composition becomes viscous, and when carbon fiber sized with the epoxy resin is subjected to a high-order processing, it is easily broken viscously while being unwound from bobbin. If the viscosity of the epoxy resin is higher than $Z_5$, the carbon fiber becomes rough and hard and fluffy easily, resulting in deterioration of the adhesion between the carbon fiber and the matrix resin. Therefore, such values outside the above-defined range are not desirable.

The proportion of the derivative of the general formula (I) or (II) as a component of the epoxy resin composition may range from 1 to 60 wt.% based on 40 to 99 wt.% of the epoxy resin, preferably from 3 to 40 wt.% based on 60 to 97 wt.% of the epoxy resin. If its proportion is smaller than 1%, the effect of preventing fluffing of carbon fiber will not be satisfactory and carbon fiber having a good rubbing resistance unobtainable. If it exceeds 60%, the resultant carbon fiber will be deteriorated in its unwindability, which is ascribable to the stickiness of the derivative of the general formula (I) or (II). Thus, those values outside the above-defined range are not desirable.

The epoxy resin composition is applied to carbon fiber as a solution in an organic solvent, examples of which solvent include aromatic hydrocarbons such as benzene, toluene and xylene, ketones such as acetone and methyl ethyl ketone, cellosolves, and halogenated hydrocarbons such as chloroform and trichlene.

The concentration of the resin composition solution in such organic solvent may range from 0.5 to 30 wt.%, preferably from 1 to 20 wt.%. If it exceeds 30%, the impregnation and uniform adhesion to carbon fiber will not be attained to a satisfactory extent, while in case it is lower than 0.5%, disadvantage will result in point of safety hygiene and cost because a larger amount of solvent is used for attaining a predetermined amount of adhesion.

In the present invention it is preferable that the amount of adhesion of the epoxy resin composition to carbon fiber be in the range of 0.1 to 10 wt.%, more preferably 0.3 to 5 wt.%, based on the weight of the carbon fiber. If the amount of adhesion is smaller than 0.1%, the desired effect of the present invention will not be attained, while if it exceeds 10%, the carbon fiber will become rough and hard and the permeation of the resin in forming the composition will be deteriorated, resulting in deterioration of the characteristics of the composite. Thus, those values outside the above-defined range are not desirable.

Means for adding the solution of the epoxy resin composition in an organic solvent of the present invention to carbon fiber is not specially limited. For example, there may be adopted a method in which the carbon fiber is immersed in the solution, a method in which the solution is applied to the carbon fiber by using a roller, or a method in which the solution is sprayed to the carbon fiber.

However, the epoxy resin solution in an organic solvent incorporating the derivative of the general formula (I) or (II) involves the following problems in sizing attributable to the fact that the solvent is an organic solvent. That is, in case the working efficiency and productivity are intended to be improved in a continuous sizing treatment for carbon fiber drawn out from a high-temperature carbonization furnace or the like, it is required to take some measures for safety hygiene and accidents prevention in sizing, thus resulting in an increased equipment burden. On the other hand, if the sizing step is separated as a separate step and the sizing treatment conducted non-continuously when viewed from the entire process, not only the working efficiency and productivity will be deteriorated, but also it becomes necessary to once wind up carbon fiber onto a bobbin or the like, convey it to the place of sizing treatment and draw out the wound-up carbon fiber from the bobbin, and when the carbon fiber is so wound up and drawn out, it is apt to be damaged mechanically and fluffed because it is not endowed with a satisfactory bundling property by sizing, thus making it impossible to attain good quality and performance of the carbon fiber. Therefore, in order for the epoxy resin composition incorporating the derivative of the general formula (I) or (II) to exhibit the sizing performance to a satisfactory extent, it is desirable to use, as the carbon fiber to be treated with the epoxy resin composition, a carbon fiber which has been bundled in advance by treatment with a small amount of an aqueous solution and/or water dispersion of a resin for sizing.

As the resin contained in such aqueous solution and/or dispersion for sizing, there may be used those which exhibit a bundling performance for carbon fiber and have a chemical affinity or adhesion to the organic solvent type sizing agent and which are capable of fully bundling carbon fiber and suppressing its fluffing in as small an amount as possible of adhesion to the carbon fiber. Examples of such resins include water-soluble or -dispersible resins such as polyalkylene oxides and derivatives thereof, polyvinyl pyrrolidone and derivatives thereof, and polyvinyl alcohol, as well as resins capable of becoming water-dispersible by addition thereof of a surface active agent, such as epoxy resins and unsaturated polyester resins. Preferably, there is used a sizing agent which contains as an essential component a polyalkylene oxide derivative of an epoxy group-containing compound, or a sizing agent containing a resin which has been rendered water-dispersible by the addition of a surface active agent, selected from an epoxy resin and/or unsaturated polyester resin.

Examples of the polyalkylene oxide derivative of an epoxy group-containing compound include glycidyl ethers of polyoxyalkylene ether such as polyoxyethylene lauryl glycidyl ether and polyethylene glycol monoglycidyl ether, glycerin monomer diglycidyl ether, sorbitol polyglycidyl ether and other glycidyl ethers of polyhydric alcohols.

These water-soluble or -dispersible polymers employable in the present invention permit, as an aqueous solution or water dispersion, sizing of carbon fiber continuously (on-line-wise) in the manufacturing process of the carbon fiber, that is, directly after going through carbonization or graphitization step, whereby the carbon fiber can be fully bundled and prevented from fluffing in subsequent steps, especially in the step of winding up the carbon fiber onto a bobbin and the step of drawing it out from the bobbin, without substantial impairment of the sizing characteristics for the carbon fiber of the organic solvent type sizing agent used as a second sizing agent.

In order for the organic solvent type sizing agent to exhibit its superior sizing performance for carbon fiber, it is necessary that the amount of adhesion of the water-soluble or -dispersible polymer to carbon fiber be as small as possible, preferably in the range of about 0.03 to 1.0 wt.%, more preferably 0.05 to 0.5 wt.%, based on the weight of carbon fiber. The concentration of the solution used for this purpose is not specially limited, but usually it ranges from 0.1 to 1.0 wt.%.

The sizing means is not specially limited, either. There may be adopted, for example, a method in which the carbon fiber is immersed in the solution, a method in which the solution is applied to the carbon fiber by using a roller, or a method in which the solution is sprayed to the carbon fiber.

For the subsequent drying treatment there may be used a known method such as, for example, hot air drying or infrared drying.

The carbon fiber thus treated with the water-soluble or -dispersible sizing agent is once wound up onto a bobbin. In this case, the sizing agent permits the carbon fiber to exhibit a good bundling performance and a superior effect of preventing fluffing and breakage of the yarn.

The thus sized carbon fiber is then treated with the solution in an organic solvent of the epoxy resin composition containing the derivative of the general formula (I) or (II) preferably in a separate step for which safety measured have been taken.

The carbon fiber treated with the organic solvent type sizing agent is then dried at a temperature usually in the range of 100° to 250° C. Drying temperatures exceeding 250° C. should be avoided because the resin composition would easily undergo heat deterioration.

The thus-obtained carbon fiber of the present invention has superior handling and bundling characteristics as well as a superior unwindability when taking out from the bobbin; besides, fluffing and yarn breakage are kept to a minimum, thus resulting in an excellent high-order processability such as prepregging or filament winding, and a composite having superior physical properties is obtainable. Particularly, in the case of using carbon fiber pre-treated with the water-soluble and/or water-dispersible sizing agent, fluffing can be prevented substantially completely when treating the carbon fiber with the solution of the epoxy resin composition in an organic solvent. Besides, owing to the superior chemical affinity or adhesion of the epoxy resin composition to the water-soluble and/or water-dispersible sizing agent, there can be attained remarkable improvements in the bundling and handling characteristics and rubbing resistance of the carbon fiber as well as its adhesion to the matrix resin.

The carbon fiber of the present invention has an excellent adhesion to various matrix resins, including epoxy, unsaturated polyester, phenol, polyphenylene sulfide, nylon and polyamide-imide. Particularly, by using the carbon fiber of the present invention it is made possible to greatly improve the physical properties of a carbon fiber composite containing as matrix an epoxy resin or an unsaturated polyester resin.

In the working and comparative examples which will be given hereinafter, the values of unwindability, rubbing resistance, filament winding (FW) processability and resin impregnatability have been obtained respectively according to the following methods. All the values represented by (parts) indicate parts by weight.

(1) Unwindability

Expressed in terms of the number of times of yarn breaking per total test length of $10^5$ m when carbon fiber wound on a bobbin is taken out vertically at a rate of 50 m/min.

(2) Rubbing Resistance (A) Carbon fiber consisting of 6000 filaments having a total size of 6000D (as yarn) is taken out transversely at a rate of 20 m/min under an initial tension of 200 g. and allowed to rub a stainless steel reed 1.1 mm in diameter for 20 minutes. Then, the resultant fluff, if any, is collected and measured for weight and expressed as weight per $10^5$ m of the carbon fiber. When this value exceeds 20 g/$10^5$ m, the processability of the carbon fiber extremely deteriorates when partially warping and weaving it.

(B) A rubbing apparatus is used in which five stainless steel bars each 10 mm in diameter having a smooth surface are disposed in parallel with one another at 50 mm intervals and in a zigzag manner so that the carbon fiber yarn can pass over their surfaces in contact therewith at an angle of 120-deg. By this apparatus, the carbon fiber yarn is allowed to pass at a rate of 3 m/m under an inlet side tension of 0.08 g/d and irradiated with laser light from a side at a right angle to the yarn, then the number of fluff is detected by a fluff detector, counted and expressed in terms of pc/m.

(3) Number of Surface Fluff

Carbon fiber yarn is placed on a white paper, the presence or absence of broken filament of yarn about 10 m long is observed through a magnifying lens and the number of broken yarn is counted. The number of surface fluff is expressed in terms of the number of broken filament per meter of the carbon fiber yarn.

(4) Resin Impregnatability

When a carbon fiber yarn consisting of 6000 filaments is impregnated with "Polymal 8225P" (a product of Takeda Chemical Industries), the time (in minutes) until this resin permeates into the carbon fiber yarn and the latter opens up to its monofilaments is measured, and the resin impregnatability is expressed in terms of this time.

(5) Physical Properties of Composite

Using the following three resins (A), (B) and (C) as matrix resins, molding is performed under the conditions set out in Table 1. The resultant test pieces are measured for the following items in accordance with the following methods.

o Inter-Layer Shear Strength (ILSS) . . . ASTM D-2344 o Tensile Strength-Elongation . . . ASTM D-3039-72-T (A) Epoxy Resin

Epikote 828 (100 parts)/$BF_3$MEA (3 parts)

(B) Epoxy Resin

ELM 434 (80 parts (a product of Sumitomo Chemical Co.)/ELM 120 (20 parts)/P,P'-diaminodiphenyl sulfone (a product of Mitsui Toatsu Chemicals) (50 parts)

(C) Unsaturated Polyester Resin

Polymal 8225P (100 parts)/methyl ethyl ketone peroxide (1 part)

TABLE 1

| | Epoxy Resin | | Unsaturated Polyester Resin |
|---|---|---|---|
| | (A) | (B) | (C) |
| Fiber Content | 60 wt. % | 60 wt. % | 60 wt. % |
| Molding Method | Arrange fiber in one direction, impregnate and mold | same as left | same as left |
| Curing Time | 140° C. × 1 hr under pressure | 190° C. × 1 hr under pressure | 120° C. × 1 hr under pressure |
| Post Cure | 150° C. × 4 hrs at normal pressure | 190° C. × 4 hrs at normal pressure | 150° C. × 2 hrs at normal pressure |
| Test Piece | 2.5 mm thick 6.0 mm wide Rectangular parallelopiped | same as left | same as left |

EXAMPLE 1, COMPARATIVE EXAMPLE 1

Various epoxy resin compositions comprising polyoxyethylene lauryl glycidyl ether $$(C_{12}H_{25}O(CH_2CH_2O)_{15}CH_2\underset{\diagdown\,O\,\diagup}{CHCH_2})$$

(10 parts) as the derivative of the general formula (II) and the epoxy resins (each 90 parts) shown in Table 2 were dissolved in an amount of 3 wt.% in methyl ethyl ketone, and carbon fiber yarns each consisting of 6000 filaments having a total size of 6000D (as yarn) were sized with the resultant solutions, then dried at 150° C. for 2 minutes by a hot air drier and then wound up onto a bobbins.

The amounts of adhesion of the resin compositions were in the range of 0.8 to 1.2 wt.% based on the weights of the carbon fiber yarns.

The thus-sized carbon fiber yarns were determined for unwindability, rubbing resistance and FW processability, the results of which are as shown in Table 2.

TABLE 2

| | No. | Sizing Agent | Viscosity of Epoxy Resin | Unwindability (time/$10^5$ m) | Rubbing Resistance (g/$10^5$ m) | FW Processability (kg) |
|---|---|---|---|---|---|---|
| Example | 1 | Epikote 1001 (90 parts)/ $C_{15}H_{25}O(CH_2CH_2O)_{15}CH_2\underset{\diagdown\,O\,\diagup}{CHCH_2}$ (10 parts) | D~F | 0 | 6 | 3.0 |
| | 2 | Epikote 1002 (90 parts)/ Epikote 1002 (10 parts) | J~S | 0 | 2 | 3.0 |
| | 3 | Epikote 1004 (90 parts)/ Epikote 1004 (10 parts) | Q~U | 0 | 2 | 3.0 |
| | 4 | Epikote 1007(90 parts)/ Epikote 1007 (10 parts) | Y~$Z_1$ | 0 | 3 | 3.0 |
| Comparative Example | 5 | Epikote 834 (90 parts)/ Epikote 834 (10 parts) | below $A_5$ | 50 | 10 | 1.0 |
| | 6 | PKHS-1* (90 parts)/ PKHS-1* (10 parts) | above $Z_6$ | 0 | 50 | 3.0 |

*a product of United Carbon Corp.

COMPARATIVE EXAMPLE 2

A sizing treatment was performed in the same way as in Example 1 except that the epoxy resins shown in Table 3 were each individually used as a sizing agent without incorporating the derivative of the general formula (I) or (II). The amounts of adhesion of the resins were in the range of 0.8 to 1.2 wt.% based on the weights of the carbon fiber yarns.

The carbon fiber yarns thus obtained were determined for unwindability, rubbing resistance and FW processability, the results of which are as shown in Table 3.

TABLE 3

| No. | Sizing Agent | Unwindability (time/$10^5$m) | Rubbing Resistance (g/$10^5$m) | FW Processability (kg) |
|---|---|---|---|---|
| 1 | Epikote 834 | 30 | 30 | 1.0 |
| 2 | Epikote 1001 | 5 | 40 | 1.8 |
| 3 | Epikote 1002 | 0 | 40 | 2.5 |
| 4 | Epikote 1004 | 0 | 60 | 2.5 |
| 5 | Epikote 1007 | 0 | 90 | 2.5 |
| 6 | PKHS-1 | 0 | 150 | 2.5 |

EXAMPLE 2, COMPARATIVE EXAMPLE 3

Various epoxy resin compositions comprising polyoxyethylenized 1,6-hexanediol glycidyl ether derivative $$(\underset{\diagdown\,O\,\diagup}{CH_2CHCH_2}(OCH_2CH_2)_{10}OC_6H_{12}O(CH_2CH_2O)_{10}CH_2\underset{\diagdown\,O\,\diagup}{CHCH_2})$$

(10 parts) as the derivative of the general formula (I) and the epoxy resins (each 90 parts) shown in Table 4 were dissolved in an amount of 3 wt.% in methyl ethyl ketone, and carbon fiber yarns each consisting of 6000 filaments having a total size of 6000D (as yarn) were sized with the resultant solutions, then dried at 150° C. for 2 minutes in a hot air drier and then wound up onto bobbins.

The amounts of adhesion of the resin compositions were in the range of 0.9 to 1.1 wt.% based on the weights of the carbon fiber yarns. The thus-sized carbon yarns were determined for unwindability, rubbing resistance and FW processability, the results of which are as shown in Table 4.

TABLE 4

| | No. | Sizing Agent | Unwindability (time/$10^5$ m) | Rubbing Resistance (g/$10^5$ m) | FW Processability (kg) |
|---|---|---|---|---|---|
| Example | 1 | Epikote 1001 (90 parts)/ Polyoxyethylenized 1,6-hexanediol glycidyl ether (10 parts) | 0 | 5 | 3.0 |
| | 2 | Epikote 1002 (90 parts)/ Epikote 1002 (10 parts) | 0 | 2 | 3.0 |
| | 3 | Epikote 1004 (90 parts)/ Epikote 1004 (10 parts) | 0 | 2 | 3.0 |
| | 4 | Epikote 1007 (90 parts)/ | 0 | 4 | 3.0 |

TABLE 4-continued

| | No. | Sizing Agent | Unwindability (time/$10^5$ m) | Rubbing Resistance (g/$10^5$ m) | FW Processability (kg) |
|---|---|---|---|---|---|
| Comparative Example | 5 | Epikote 1007 (10 parts) Epikote 834 (90 parts)/ Epikote 834 (10 parts) | 70 | 10 | 1.0 |
| | 6 | PKHS-1 (90 parts)/ PKHS-1 (10 parts)/ | 0 | 60 | 3.0 |

EXAMPLE 3

Using epoxy resin composition comprising Epikote 1002 as epoxy resin and the derivatives of the general formula (II) shown in Table 5, the carbon fiber yarns were subjected to sizing treatment in the same way as in Example 1. The blending ratio of Epikote 1002 and each of the derivatives of the general formula (II) was 90:10 (weight ratio).

The amounts of adhesion of the sizing agents were in the range of 0.8 to 1.2 wt.% based on the weights of the carbon fiber yarns.

The thus-sized carbon fiber yarns were determined for unwindability, rubbing resistance and FW processability, the results of which are as shown in Table 5.

TABLE 5

| No. | Derivative of General Formula (II) | Unwindability (time/$10^5$ m) | Rubbing Resistance (g/$10^5$ m) | FW Processability (kg) |
|---|---|---|---|---|
| 1 | $C_9H_{19}O(CH_2CH_2O)_{10}CH_2CHCH_2$ (O) | 0 | 4 | 2.5 |
| 2 | $C_{12}H_{25}O(CH_2CH_2CH_2O)_{15}CH_2CHCH_2$ (O) | 0 | 2 | 3.0 |
| 3 | $C_{16}H_{33}O(CH_2CH_2O)_{20}CH_2CHCH_2$ (O) | 0 | 2 | 3.0 |

EXAMPLE 4, COMPARATIVE EXAMPLE 4

A sizing treatment was performed in the same way as in Example 1 except that resin compositions each comprising ① Epikote 1002 and ② $CH_2CHCH_2(OCH_2CH_2)_{10}O—C_6H_{12}—O(CH_2CH_2O)_{10}CH_2CHCH_2$ (O) as the derivative of the general formula (I), or ① and ③ $C_{12}H_{25}O(CH_2CH_2O)_{15}—CH_2CHCH_2$ (O)

as the derivative of the general formula (II), were used as sizing agents and that the blending ratio of the compositions was varied as shown in Table 6.

The amounts of adhesion of the resin compositions were in the range of 0.8 to 1.4 wt.% based on the weights of the carbon fiber yarns.

The carbon fiber yarns thus treated were determined for unwindability, rubbing resistance and resin impregnatability, the results of which are as shown in Table 6.

TABLE 6

| No. | Blending Ratio of Sizing Agent (by part) ① | ② | ③ | Unwindability (time/$10^5$m) | Rubbing Resistance (g/$10^5$m) | Resin Impregnatability (min) | |
|---|---|---|---|---|---|---|---|
| 1 | 100 | 0 | | 0 | 40 | 30 | Comparative Example |
| 2 | 99 | 1 | | 0 | 10 | 25 | Example |
| 3 | 90 | 10 | | 0 | 2 | 7 | " |
| 4 | 70 | 30 | | 0 | 2 | 5 | " |
| 5 | 50 | 50 | | 3 | 2 | 3 | " |
| 6 | 30 | 70 | | 5 | 3 | 4 | Comparative Example |
| 7 | 0 | 100 | | 25 | 5 | 3 | Comparative Example |
| 8 | 100 | | 0 | 0 | 40 | 30 | Comparative Example |
| 9 | 99.5 | | 0.5 | 0 | 20 | 30 | Comparative Example |
| 10 | 99 | | 1 | 0 | 12 | 25 | Example |
| 11 | 95 | | 5 | 0 | 5 | 10 | " |
| 12 | 90 | | 10 | 0 | 3 | 8 | " |
| 13 | 70 | | 30 | 0 | 4 | 5 | " |
| 14 | 50 | | 50 | 5 | 3 | 4 | " |
| 15 | 30 | | 70 | 20 | 10 | 2 | Comparative Example |
| 16 | 0 | | 100 | 50 | 15 | 4 | Comparative Example |

EXAMPLE 5, COMPARATIVE EXAMPLE 5

Using the carbon fiber yarns obtained in Examples 1 and 2 and Comparative Example 2 and under the molding conditions shown in Table 7, test pieces were prepared and determined for inter-layer shear strength and tensile strength-elongation, the results of which are as shown in Table 7.

TABLE 7

| | No. | Sizing Agent | Physical Properties of Composite: ILSS (kg/mm²) Matrix Resin (A) | ILSS (B) | ILSS (C) | Tensile Strength (kg/mm²) (A) | Tensile Strength (B) | Tensile Strength (%) (A) | Tensile Strength (%) (B) |
|---|---|---|---|---|---|---|---|---|---|
| Example | 1 | Epikote 1001 (90 parts)/ $CH_{12}H_{25}O(CH_2CH_2O)_{15}CH_2CHCH_2$ (O) (10 parts) | 9.0 | 13.5 | 8.4 | 168 | 218 | 1.25 | 1.56 |
| | 2 | Epikote 1002 (90 parts)/ Epikote 1002 (10 parts) | 8.9 | 13.0 | 8.3 | 168 | 215 | 1.25 | 1.57 |
| | 3 | Epikote 1004 (90 parts)/ Epikote 1004 (10 parts) | 8.8 | 13.3 | 8.4 | 165 | 215 | 1.25 | 1.55 |
| | 4 | Epikote 1007 (90 parts)/ Epikote 1007 (10 parts) | 8.7 | 13.0 | 7.5 | 165 | 208 | 1.23 | 1.53 |
| | 5 | Epikote 1001 (90 parts)/ $C_6H_{12}(O(CH_2CH_2O)_{10}CH_2CHCH_2)_2$ (O) (10 parts) | 9.0 | 13.3 | 8.2 | 168 | 220 | 1.25 | 1.57 |
| | 6 | Epikote 1002 (90 parts)/ Epikote 1002 (10 parts) | 9.0 | 13.5 | 8.3 | 170 | 218 | 1.26 | 1.56 |
| | 7 | Epikote 1004 (90 parts)/ Epikote 1004 (10 parts) | 8.9 | 13.5 | 8.3 | 158 | 219 | 1.24 | 1.57 |
| | 8 | Epikote 1007 (90 parts)/ Epikote 1007 (10 parts) | 8.7 | 13.2 | 7.6 | 162 | 210 | 1.22 | 1.54 |
| | 9 | Epikote 1001 | 8.5 | 12.5 | 8.2 | 160 | 205 | 1.19 | 1.47 |
| Comparative Example | 10 | Epikote 1002 | 8.7 | 12.6 | 8.1 | 162 | 202 | 1.20 | 1.48 |
| | 11 | Epikote 1004 | 8.5 | 12.3 | 8.0 | 160 | 208 | 1.20 | 1.50 |
| | 12 | Epikote 1007 | 8.6 | 12.4 | 7.0 | 160 | 200 | 1.19 | 1.47 |
| | 13 | No sizing agent used | 8.2 | 11.5 | 6.5 | 155 | 190 | 1.15 | 1.40 |

EXAMPLE 6, COMPARATIVE EXAMPLE 6

A carbon fiber yarn ("Torayca" T300, a product of Toray Industries Inc.) consisting of 6000 filaments having a total size of 6000D (as yarn) was, as a first stage, immersed in a 0.3 wt.% aqueous solution of polyoxyethylene (15 mols) lauryl glycidyl ether and thereby sized, then dried at 190° C. and wound up. The amount of adhesion of the resin was 0.06% based on the weight of the carbon fiber yarn.

Then, as a second stage, a 6 wt.% solution in ethyl cellosolve of a sizing agent comprising 90 parts by weight of a resin mixture (1:3) of Epikote 828 (a product of Shell Chemical) and Epikote 1004 (a product of Shell Chemical) and 10 parts by weight of polyoxyethylene (15 mols) lauryl glycidyl ether was applied to the yarn, which was then dried at 185° C. and wound up. The total amount of adhesion of the sizing was 0.8% based on the weight of the carbon fiber yarn.

By way of comparison, the treatment in Example 6 was repeated except that the sizing treatment with the aqueous polyoxyethylene (15 mols) lauryl glycidyl ether solution was not performed. The amount of adhesion of the sizing agent to the carbon fiber yarn was 0.8% based on the weight of the yarn.

The carbon fiber yarns thus treated were measured for fluff, the results of which are as shown in Table 8.

TABLE 8

| | Without 1st Stage Sizing Treatment: Surface | Rubbed | After 1st Stage sizing Treatment: Surface | Rubbed | After 2nd Stage sizing Treatment: Surface | Rubbed |
|---|---|---|---|---|---|---|
| | Fluff (pc/m) | Fluff (pc/m) | Fluff (pc/m) | Fluff (pc/m) | Fluff (pc/m) | Fluff (pc/m) |
| Example 6 | — | — | 5 | 16 | 2 | 7 |
| Comparative Example 6 | 24 | 97 | — | — | 12 | 29 |

EXAMPLE 7

The treatment in Example 6 was repeated except that a 0.3 wt.% aqueous solution of a polyoxyethylenized 1,6-hexanediol glycidyl ether derivative $$(CH_2CHCH_2(OCH_2CH_2)_{10}OC_6H_{12}O(CH_2CH_2O)_{10}-CH_2CHCH_2)$$

(O) (O)

was used in the first stage sizing treatment. The amount of adhesion of the sizing agent was 0.05% at the first stage, and the total amount of adhesion after completion of the second stage sizing treatment was 1.0%. The carbon fiber yarn thus treated was measured for fluff, the results of which are as shown in Table 9.

TABLE 9

| After 1st Stage Sizing Treatment | | After 2nd Stage Sizing Treatment | |
|---|---|---|---|
| Surface Fluff (pc/m) | Rubbed Fluff (pc/m) | Surface Fluff (pc/m) | Rubbed Fluff (pc/m) |
| 6 | 18 | 3 | 7 |

EXAMPLE 8

A sizing treatment was performed in the same way as in Example 6 except that, as the sizing agent in the first stage sizing treatment, there was used, in place of the polyoxyethylene lauryl glycidyl ether, a 0.3 wt.% water dispersion of an emulsion comprising:

(a) Epikote 828: 30 (parts by weight)

(b) Condensate of 2 mols EO (2 mols) adduct of Bisphenol A, 1.5 mols of maleic acid and 0.5 mol of sebacic acid: 20 (parts by weight)

(c) Polyoxyethylene (70 mols) styrenized (5 mols) cumyl phenol: 5 (parts by weight)

(d) Water: 45 (parts by weight)

The amount of adhesion of the sizing agent at the first stage was 0.07% and the total amount of adhesion was 0.9%. The carbon fiber yarn thus treated was measured for fluff, tge results of which are as shown in Table 10.

TABLE 10

| After 1st Stage Sizing Treatment | | After 2nd Stage Sizing Treatment | |
|---|---|---|---|
| Surface Fluff (pc/m) | Rubbed Fluff (pc/m) | Surface Fluff (pc/m) | Rubbed Fluff (pc/m) |
| 7 | 17 | 4 | 8 |

What is claimed is:

1. A carbon fiber superior in high-order processability and in physical properties as a composite, said carbon fiber having been treated with an epoxy resin composition, said epoxy resin composition comprising an epoxy resin and at least one polyalkylene ether glycol derivative selected from the group consisting of a polyoxyethylenized 1,6-hexanediol glycidyl ether, a polyoxyethylene styrenized cumyl phenol, an alkylene bis-(ϵ-glycidyl polyalkylene oxide ether), a polyoxyethylene lauryl glycidyl ether and an alkyl (ϵ-glycidyl polyalkylene oxide ether).

2. The carbon fiber of claim 1, wherein said epoxy resin composition has a viscosity in the range of $A_1$ to $Z_5$ measured by a Gardner-Holdt viscometer as a 40 weight percent solution thereof in diethylene glycol monobutyl ether solution at 25° C., said epoxy resin composition comprising a mixture of 40–99 weight percent of said epoxy resin and 1–60 weight percent of said polyalkylene ether glycol derivative.

3. The carbon fiber of claim 1 or claim 2, wherein said epoxy resin composition has a viscosity in the range of $A_1$ to $Z_5$ measured by a Gardner-Holdt viscometer as a 40 weight percent solution thereof in diethylene glycol monobutyl ether at 25° C., said epoxy resin composition comprising a mixture of 60–97 weight percent of said epoxy resin and 3 to 40 weight percent of said derivative.

4. The carbon fiber of any one of claims 1 or 2 or 3, wherein the amount of said epoxy resin composition adhered to the carbon fiber is in the range of 0.1 to 10 weight percent based on the weight of the carbon fiber.

* * * * *